US005878503A

United States Patent [19]

Howe et al.

[11] Patent Number: 5,878,503

[45] Date of Patent: Mar. 9, 1999

[54] GUN SIGHT SYSTEM

[75] Inventors: Phillip D. Howe, Ft. Collins; Phillip Sutorius, Longmont; Robert Simon, Loveland, all of Colo.

[73] Assignee: North Pass, Ltd., Longmont, Colo.

[21] Appl. No.: 706,616

[22] Filed: Sep. 5, 1996

[51] Int. Cl.[6] ..... F41G 1/32

[52] U.S. Cl. ..... 33/241; 42/100

[58] Field of Search ..... 33/241, 242, 243; 42/100, 103

[56] References Cited

U.S. PATENT DOCUMENTS

| | | | |
|---|---|---|---|
| Re. 35,347 | 10/1996 | Bindon | 33/241 |
| 2,295,791 | 9/1942 | Hornback | 33/241 |
| 2,706,335 | 4/1955 | Munsey | 33/241 |
| 2,795,048 | 6/1957 | Seymour et al. | 42/100 |
| 2,822,616 | 2/1958 | Gangl | 42/100 |
| 2,924,881 | 2/1960 | Gee | 33/50 |
| 2,931,101 | 4/1960 | Martin | 33/50 |
| 3,007,248 | 11/1961 | Detrich | 33/50 |
| 3,037,288 | 6/1962 | Detrich | 33/50 |
| 3,500,545 | 3/1970 | Chivers | 33/241 |
| 3,700,339 | 10/1972 | Steck, III | 356/247 |
| 3,911,607 | 10/1975 | Luebkeman | 42/100 |
| 3,949,482 | 4/1976 | Ross | 42/100 |
| 4,030,203 | 6/1977 | Ackerman, Jr. | 33/241 |
| 5,201,124 | 4/1993 | Sherman | 33/265 |

*Primary Examiner*—Charles T. Jordan
*Assistant Examiner*—Meena Chelliah
*Attorney, Agent, or Firm*—Dean P. Edmundson

[57] ABSTRACT

A high visibility gun sight system is described for detachable mounting on a gun barrel (e.g., a shotgun). The system includes a base member for detachably mounting to a gun barrel, and an elongated light-gathering plastic rod which is detachably mounted to the base member. Preferably the base member includes downwardly extending flanges for engaging the gun barrel. The flanges can include opposing fingers for self-aligning of the base member on the barrel. Magnets can be included in the base member for retaining the base member on the gun barrel.

19 Claims, 2 Drawing Sheets

GUN SIGHT SYSTEM

FIELD OF THE INVENTION

This invention relates to gun sight systems. More particularly, this invention relates to detachable gun sights for use on guns such as shotguns.

BACKGROUND OF THE INVENTION

Shotguns typically have a raised bead on the outer or distal end of the barrel to be used for determining a proper line of sight when aiming the shotgun at a desired target. In low-light conditions, however, it can be difficult to view the bead on the outer end of the barrel.

There has not heretofore been provided a gun sight system having the features and advantages provided by the present invention.

SUMMARY OF THE PRESENT INVENTION

In accordance with the present invention there is provided a high-visibility gun sight system for detachable mounting on a gun barrel. In one embodiment the gun sight system comprises:

(a) a base member including mounting means for detachable mounting of the base member to the gun barrel; and (b) elongated, light-gathering means detachably mounted to the base member. The base member is adapted to be detachably mounted on the top of the gun barrel. The light-gathering means is preferably a length of solid cylindrical colored plastic which is light-transparent. The exterior surface of the plastic is very smooth or polished, and the forward end is preferably angled or sloped and is planar. The rearward or viewing end may be slightly enlarged, if desired, and has a matte surface. The light-gathering means gathers light and produces a highly-visible bead of light at the viewing end of the device.

Preferably the base member is self-centering on the raised rib of a gun barrel. This feature is very significant because the user does not have to do anything other than to place the base member on top of the rib of the barrel. The base member automatically aligns itself on the rib of the barrel so that the elongated light-gathering means will be properly aligned with the longitudinal axis of the gun barrel.

Preferably the base member includes one or more magnets to enable the base member to be detachably attached to the rib of a gun barrel. Thus, when it is desired to detach or remove the gun sight system, it is only necessary to lift the base member off the gun barrel. No tools are required.

Preferably the light-gathering means is also detachable from the base member. This enables a new or different light-gathering means to be installed on the base member.

Other advantages and features of the gun sight system of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
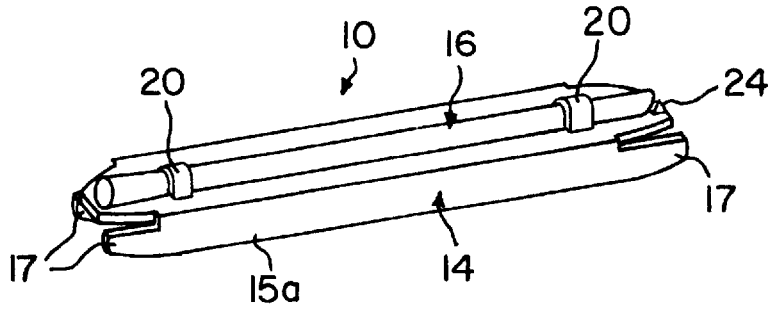
FIG. 1 is a perspective view of a preferred embodiment of a gun sight system of the invention.
Figure 1A:
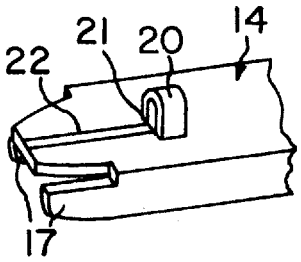
FIG. 1A is a perspective view of one end of the base member shown in FIG. 1.
Figure 3:
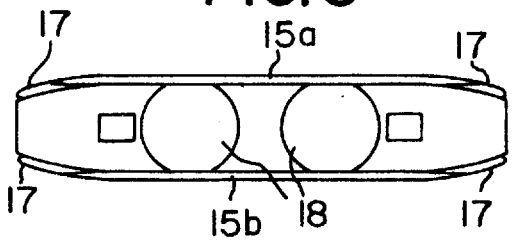
FIG. 3 is a bottom plan view of the gun sight system shown in FIG. 1.
Figure 2:
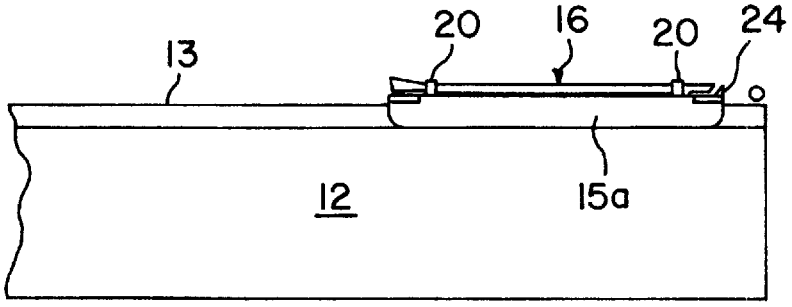
FIG. 2 is a side elevational view of the gun sight system shown in FIG. 1 attached to a raised rib of a shotgun barrel.
Figure 4:
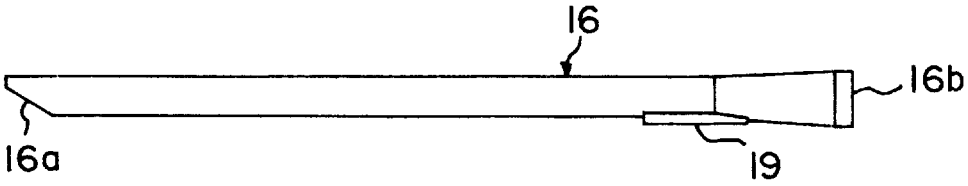
FIG. 4 is a side elevational view of a preferred form of light-gathering means which is used in the system of this invention.

In FIGS. 1–4 there is shown a preferred embodiment of gun sight system 10 of the invention for use on a gun barrel 12 of the type having a raised rib 13 extending along the top edge of the barrel (i.e., parallel to the longitudinal axis of the barrel). This embodiment of gun sight system includes a base member 14 and an elongated light-gathering tube or rod means 16 which is detachably mounted on the upper surface of the base member.

The base member includes an upper surface and downwardly-extending opposing flanges 15A and 15B defining an elongated channel. Preferably the ends of each flange include resilient and flexible fingers 17 which are biased inwardly toward the longitudinal centerline of the base member and which engage the opposite sides of the raised rib 13 of the gun barrel and thereby serve to self-center the base member on the raised rib. This self-centering feature is extremely important because it causes the light-gathering means 16 to be longitudinally aligned with the rib 13 and the barrel 12.

Preferably the base member also includes one or more magnets 18 for attaching and holding the base member to the raised rib 13 of the gun barrel 12. Yet, when it is desired to remove the gun sight system, all that is required is to lift the base member off the raised rib.

The light-gathering means 16 preferably comprises a length of solid cylindrical colored plastic rod which is light-transparent. Preferably the exterior surface of the plastic rod is very smooth or polished. The forward end 16A of the plastic rod is preferably a sloped planar end. The rearward or viewing end of the plastic rod preferably has a planar surface which is a matte or slightly roughened surface.

The length of the plastic rod 16 may vary but is generally in the range of about 0.5 to 3 inches. The diameter may also vary, but it is generally in the range of about 0.03 to 0.25 inch.

The plastic rod can be formed from a variety of well-known plastics such as acrylic, nylon, polycarbonate, polystyrene, etc. in which a soluble colored dye is included. Generally speaking, any self-supporting light-transparent plastic may be used for this purpose.

If desired, the rearward or viewing end 16B of the plastic rod can be enlarged as shown in the drawings. However, it is not necessary for the viewing end to be enlarged in this manner.

The elongated plastic rod can be detachably secured to the upper surface of the base member in a number of different ways. A simple and effective manner, as shown in the drawings, involves the use of hoops or stirrups 20 extending upwardly from the upper surface of the base member. The hoops snugly or closely engage the exterior surface of the plastic rod at two spaced-apart points along the length of the plastic rod. The hoops are positioned such that they hold and support the plastic rod in a plane parallel to the longitudinal axis of the gun barrel and in proper alignment with the longitudinal axis of the barrel.

Preferably the plastic rod includes a raised key member 19 which is received in an opening or detent 21 in the upper surface of the base member. Preferably the upper surface of the base member also includes a longitudinal recess or groove 22 for guiding the key 19 on a plastic rod to the detent 21 when the plastic rod is being slidably inserted beneath the hoops 20 on the base member.

Preferably the opposite end of the base member includes a raised stop member 24. This stop member serves to prevent the plastic rod from being pushed too far forwardly on the base member. It also prevents the forward end of the plastic rod from catching or snagging on brush, weeds, twigs, etc.

Because the plastic rod is detachable from the base member, it is very easy to install a new plastic rod whenever that is necessary or desirable. For example, differently colored plastic rods can be used for differing light conditions.

Figure 5:
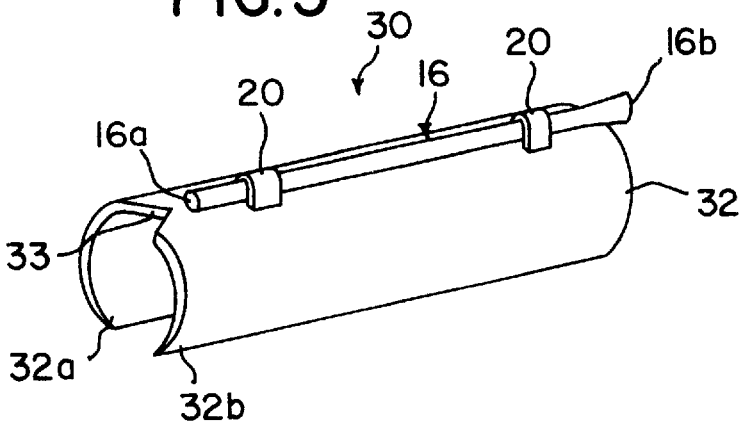
FIG. 5 is a perspective view of another embodiment of gun sight system of the invention.
Figure 6:
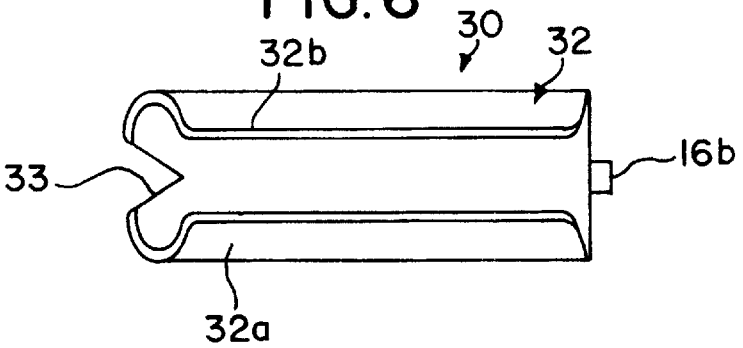
FIG. 6 is a bottom view of the embodiment of the gun sight system shown in FIG. 5.

FIGS. 5 and 6 illustrate another embodiment of gun sight system 30 for use on gun barrels which do not include a raised rib. This embodiment comprises a generally-cylindrical body 32 having opposing resilient flanges 32A and 32B for gripping and engaging a gun barrel to hold the body 32 on the barrel. One end of the body 32 includes a V-shaped notch 33 for engaging the raised bead on the outer end of the barrel and thereby aligning the body member with the barrel. In other words, the plastic rod light-gathering means 16 mounted on the top edge of body 32 is thereby caused to be properly aligned with the raised bead on the barrel. Also, the body 32 and hoops 20 support the plastic rod 16 parallel to the longitudinal axis of the barrel.

The body 32 may be provided in any desired length and in any desired diameter so that the gun sight system can be used on any diameter gun barrel. Preferably, body 32 is comprised of resilient plastic.

Other variants are possible without departing from the scope of this invention.

What is claimed is:

1. A high-visibility gun sight system for detachable mounting on a gun baffel, said system comprising:

(a) a base member including mounting means for detachable mounting of said base member to said gun barrel; wherein said base member has forward and rearward ends and an upper surface; wherein said base member further includes downwardly extending flange members for engaging said gun barrel; and (b) elongated, light-gathering tube means detachably mounted to said upper surface of said base member; wherein said light-gathering tube means includes a smooth surface and a sloped end; wherein said sloped end is planar.

2. A system in accordance with claim 1, wherein said flange members define an elongated channel.

3. A system in accordance with claim 1, wherein said upper surface of said base member includes upwardly extending hoop members for mounting said tube means to said base member.

4. A system in accordance with claim 1, wherein said tube means further includes a viewing end having a matte surface.

5. A system in accordance with claim 1, wherein said tube means comprises a length of solid cylindrical colored plastic which is light-transparent.

6. A system in accordance with claim 5, wherein said tube means has a length in the range of about 0.5 to 3 inches and a diameter in the range of about 0.030 to 0.25 inch.

7. A system in accordance with claim 1, wherein said tube means further includes a raised key means on said surface; and wherein said base member further includes a recessed area for receiving said key means.

8. A system in accordance with claim 5, wherein said base member further includes magnet means for detachable attachment of said base member to said gun barrel.

9. A system in accordance with claim 2, wherein said flange members include opposing resilient, flexible fingers for self-centering said base member on a raised rib of a gun barrel.

10. A system in accordance with claim 1, wherein said base member is tubular and said flange members are curved; and wherein said forward end includes a V-shaped notch.

11. A high-visibility gun sight system for detachable mounting on a gun barrel, said system comprising:

(a) an elongated base member having forward and rearward ends and an upper surface; wherein said base member further includes downwardly extending flange members for detachably engaging said gun barrel; and (b) elongated, light-gathering means detachably mounted to said upper surface of said base member; wherein said light-gathering means comprises a length of cylindrical colored plastic rod which is light-transparent and has a smooth surface and planar sloped end.

12. A system in accordance with claim 11, wherein said flange members define an elongated channel; and wherein said flange members each include resilient, flexible fingers.

13. A system in accordance with claim 11, wherein said light-gathering means further includes a viewing end having a matte surface.

14. A system in accordance with claim 11, wherein said colored plastic rod further includes a raised key means on said surface; and wherein said base member further includes a recessed area for receiving said key means.

15. A system in accordance with claim 11, wherein said base member further includes magnet means for detachable attachment of said base member to said gun barrel.

16. A high-visibility gun sight system for detachable mounting on a gun barrel, said system comprising:

(a) an elongated base member having forward and rearward ends and an upper surface; wherein said base member further includes downwardly extending flange members for detachably engaging said gun barrel; and wherein said flange members include opposing resilient, flexible fingers; and wherein said base member further includes magnet means for detachable attachment of said base member to said gun barrel;

(b) elongated, light-gathering tube means detachably mounted to said upper surface of said base member; wherein said light-gathering means comprises a length of cylindrical colored plastic rod which is light-transparent and has a smooth surface and a planar sloped forward end; wherein said plastic rod further includes a viewing end having a matte surface.

17. A combination comprising:

(a) an elongated shotgun barrel having a raised rib extending along said barrel;

(b) a U-shaped base member including an upper surface and downwardly extending opposing parallel flanges defining an elongated channel for detachable mounting of said base member directly to said rib on said barrel; wherein said base member further includes magnet means within said channel for detachable attachment of said base member solely to said rib; and (c) elongated, light-gathering tube means mounted to said upper surface of said base member.

18. A high-visibility gun sight system for detachable mounting on a raised rib of a barrel of a shotgun, said system comprising:

(a) an elongated U-shaped base member having forward and rearward ends and an upper surface; wherein said base member further includes downwardly extending parallel flange members defining an elongated channel for detachably engaging solely said rib; wherein said base member further includes magnet means within said channel for detachable attachment of said base member directly to said rib; and (b) elongated, light-gathering means mounted to said upper surface of said base member.

19. A high-visibility gun sight system for detachable mounting on a raised rib of a barrel of a shotgun, said system comprising:

(a) a U-shaped base member for detachable mounting to said raised rib; wherein said base member has forward and rearward ends and an upper surface; wherein said base member further includes downwardly extending parallel flange members defining an elongated channel for engaging solely said raised rib; and (b) elongated, light-gathering tube means detachably mounted on said upper surface of said base member; wherein said tube means includes a smooth surface and a sloped end; wherein said tube means further includes a raised key means on said smooth surface;

and wherein said base member further includes a recessed area for receiving said key means.

* * * * *